United States Patent [19]

Martin

[11] Patent Number: 4,465,198

[45] Date of Patent: Aug. 14, 1984

[54] EXPANDABLE TOWEL RACK

[76] Inventor: Jack Martin, 434 Rahway Ave., Woodbridge, N.J. 07095

[21] Appl. No.: 418,704

[22] Filed: Sep. 16, 1982

[51] Int. Cl.[3] ..... A47F 5/08

[52] U.S. Cl. ..... 211/105.3; 211/123; 211/175; D6/549

[58] Field of Search ..... 211/105.1, 105.2, 123, 211/86, 175, 105.3, 87, 16, 35, 182, 57.1, 59.1; D6/99; 4/599, 600, 576, 577, 610

[56] References Cited

U.S. PATENT DOCUMENTS

| | | | |
|---|---|---|---|
| 951,832 | 3/1910 | McMahon | 211/87 |
| 1,002,063 | 8/1911 | Jasper | 211/175 X |
| 1,409,056 | 3/1922 | Michaels | 211/123 |
| 2,504,319 | 4/1950 | Freeman | 211/105.1 |
| 2,622,743 | 12/1952 | Ross | 211/59.1 X |
| 2,640,671 | 6/1953 | Grady | 211/105.1 X |
| 2,653,718 | 9/1953 | Woodward | 211/105.2 |
| 2,655,268 | 10/1953 | Whaley | 211/87 |
| 2,825,469 | 3/1958 | Watkins et al. | 211/123 X |

*Primary Examiner*—Ramon S. Britts
*Assistant Examiner*—Robert W. Gibson, Jr.
*Attorney, Agent, or Firm*—Arthur L. Plevy

[57] ABSTRACT

There is disclosed an expandable towel rack which comprises a central base member having a left and a right extending tubular section. A left and a right U-shaped section, each having one arm adapted to coact with the corresponding arm of the base member. The other arms of the U-shaped member are accommodated within an outer support member. In this manner the entire assembly can be adjusted in length by controlling the depth of insert of the U-shaped members with respect to the base member and with respect to the outer support member.

4 Claims, 2 Drawing Figures

EXPANDABLE TOWEL RACK

BACKGROUND OF INVENTION

This invention relates to a wall rack and more particularly to an expandable rack for holding towels.

The prior art is replete with a number of patents depicting adjustable racks for holding various articles. In particular, there is a problem associated with towel racks due to the fact that bath towels and similar articles are sold in various sizes. Hence, in order to accommodate different sizes, it is preferable to have a rack which is capable of being expanded as lengthened and shortened while the same is emplaced or affixed to a wall. In regard to such prior art techniques, reference is made to U.S. Pat. No. 2,825,469 entitled EXPANDABLE WALL RACK issued on Mar. 4, 1958 to R. L. Watkins, et al. This patent shows an expandable wall rack for towels which uses a main hollow bar with supporting arms. The rack shown is capable to being expanded but once adjusted to a proper size remains fixed in that position. Other patents such as U.S. Pat. No. 2,655,268 entitled EXTENDABLE RACK also relates to a towel rack which uses a telescoping arrangement of a U-shaped configuration. This rack extends from the wall but is relatively unattractive and difficult to implement.

It is, therefore, an object of the present invention to provide an improved rack which is particularly adapted for accommodating towels and which rack can be expanded while emplaced on a wall. The rack is extremely simple to adjust and to fabricate.

BRIEF DESCRIPTION OF THE PREFERRED EMBODIMENT

An expandable wall rack assembly particularly adapted for accommodating towels, comprising a central base member having a rear surface to be positioned on a wall, said base member including a tubular member extending from a front surface and having symmetrical right and left arms extending from opposite sides of said base member. The first and second symmetrical U-shaped side members; each having one arm slideably mounted on a corresponding arm of said base member with the bases of said U-shaped members facing each other, an outer support member of a tubular configuration moveably positioned between the other arms of said U-shaped side members.

DETAILED DESCRIPTION OF INVENTION

Figure 1:
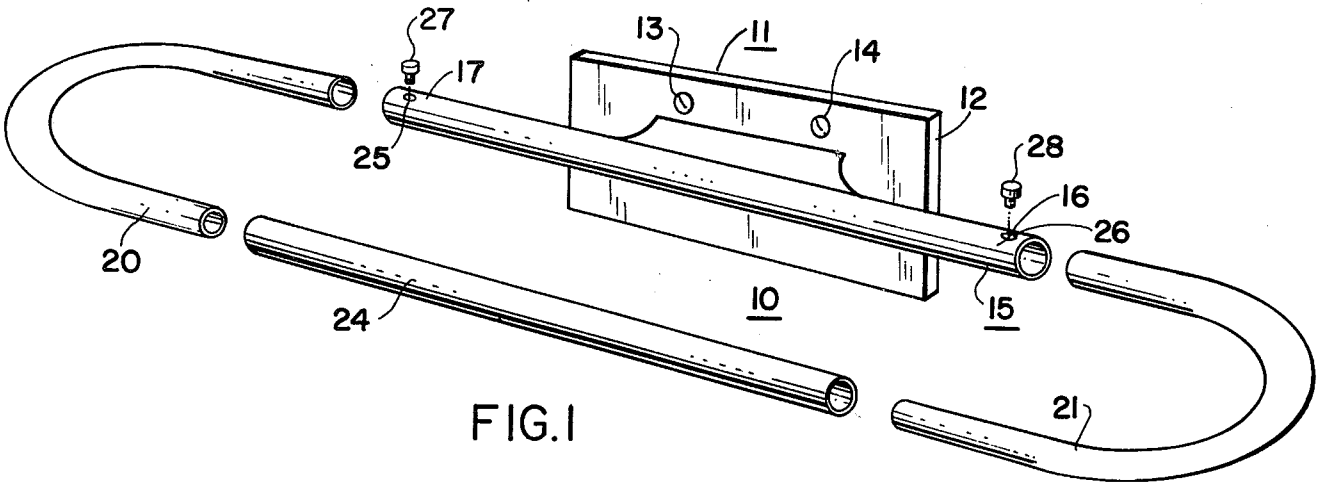
FIG. 1 is a perspective plan view of an expandable towel rack according to this invention.

Referring to FIG. 1, there is shown a perspective view of a wall rack according to this invention. As can be seen from FIG. 1, the rack depicted consists of 4 separate parts as will be explained. There is shown a base plate 11 which constitutes a planar back surface 12 having suitable apertures such as 13 and 14 to accommodate fastening devices such as screws to enable the base to be mounted on a wall. It is, of course, understood that the base may also be glued or otherwise secured to a suitable surface such as a tile surface and so on. Extending from the base 11 is a central support member 15. The central member 15 includes right and left hollow tubular arms 16 and 17. The arms 16 and 17 extend from the base a desired distance depending upon the particular maximum expanded rack size. Also located in each arm 16 and 17 is an aperture as 25 and 26. The apertures 25 and 26 may accommodate a set screw as 27 and 28 to maintain the rack in a particular orientation if desired. The arms 16 and 17 are adapted to accomodate two identical U-shape members 20 and 21, which form the ends of rack 10. A corresponding arm of each U-shaped member is emplaced within the apertures of the central support member 15. The other arms of each U-shaped member 20 and 21 are emplaced within an outer tubular member 24. In this manner as one can ascertain from the above description, the entire length of the composite assembly can be adjusted by the positioning of member 20 and of member 21 within the central support member 15 and thence by the positioning of the outer member 24 about the other arms. As can be seen when the unit is placed in a desired position manifesting a desired length, the assembly is extremely rapid as all parts interlock and the assembly is held together in this manner. It is, of course, understood that the assembled parts may either overlap or set within one another. For example, the outer arms of the U-shaped members 20 and 21 may be inserted into the apertures of the central support member 15. In this case the outer diameters of the U-shaped members 20 and 21 would be smaller than the inner diameter of the support member 15. Alternately, if the diameters of the U-shaped members were larger than the outer diameter of member 17 they would be emplaced over member 17. The same operation can be achieved with member 24 as positioned with the outer arms of U-shaped members 20 and 21.

Figure 2:
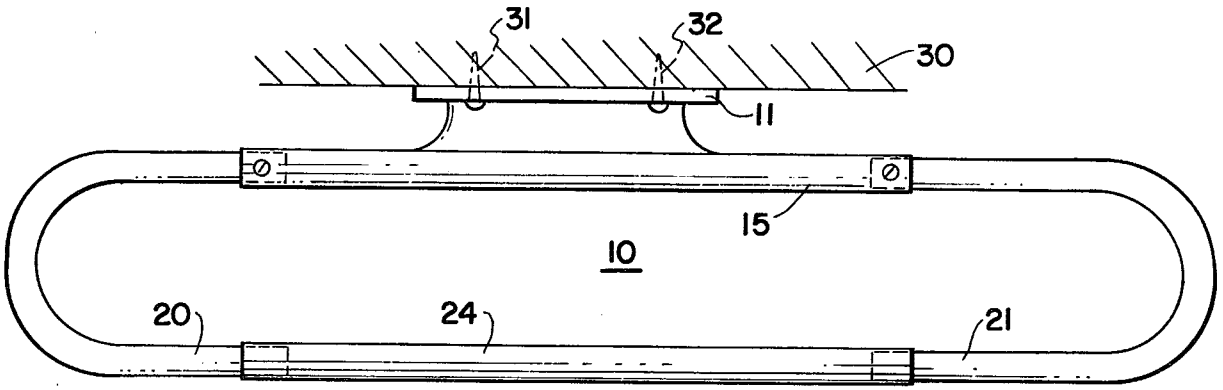
FIG. 2 is a top plan view of the adjustable towel rack according to this invention.

FIG. 2, depicts a top view of an assembled towel rack according to the principles of FIG. 1. In FIG. 2, the base member is secured to a wall 30 by means of two screws 31 and 32 directed through apertures 13 and 14. Thus, it would be apparent from the above noted description and from the figures how the entire assembly operates. It is, of course, understood that members 20 and 21 are completely symmetrical and hence, the manufacturing costs of such a unit are substantially reduced. While the members are shown having circular cross sections, it is understood that other geometrical cross sections can be employed as well, such as square, rectangular and so on. The entire unit can be fabricated from plastic component parts or metallic tubular members according to the preference of the user and manufacturer. As can be seen, the assembly can be adjusted continually as desired due to the nature of the construction and operation. There is thus provided a new and improved expandable towel rack which is simple to operate and simple to manufacture.

Various modifications and alternative designs will become apparent to one skilled in the art when reviewing the above noted disclosure and all such modifications and alternatives are deemed to be encompassed with the spirit and scope of the claims appended hereto.

I claim:

1. An expandable wall rack assembly particularly adapted for accommodating towels, comprising:

(a) A central base member having a rear surface adapted to be positioned on a wall, said base member including a tubular member extending from a front surface and having symmetrical right and left arms extending from opposite sides of said base member, (b) first and second symmetrical U-shaped side members; each having one arm slideably mounted on a corresponding arm of said tubular member with the inner surfaces of said U-shaped members facing each other, (c) an outer support member of a tubular configuration moveably positioned between the other arms of said U-shaped side members, (d) means located on at least one of said arms of said tubular member to secure said arm of said U-shaped member in a desired position.

2. The expandable wall rack assembly according to claim 1, wherein said tubular member extending from said base member has a circular cross section.

3. The expandable wall rack assembly according to claim 1, wherein said base member includes a plurality of apertures on said front surface for mounting said member on a wall by inserting fastening means through said apertures.

4. The expandable wall rack assembly according to claim 1, wherein said central base member is a planar member.

* * * * *